US005213364A

United States Patent [19]

Theckston

[11] Patent Number: 5,213,364

[45] Date of Patent: May 25, 1993

[54] GOLF CLUB HOLDER AND DISPENSER

[76] Inventor: Dana L. Theckston, 2101 S. 324th St., Sp. 55, Federal Way, Wash. 98003

[21] Appl. No.: 875,420

[22] Filed: Apr. 29, 1992

[51] Int. Cl.[5] ..... B60R 11/00

[52] U.S. Cl. ..... 280/769; 280/DIG. 5; 211/70.2; 224/274; 248/499; 206/315.6

[58] Field of Search ..... 224/274; 296/3, 37.1; 280/DIG. 5, DIG. 6, 47.26, 769; 211/70.2; 248/96, 499, 505; 206/315.2-315.8, 315.11; 221/76, 69, 185, 119

[56] References Cited

U.S. PATENT DOCUMENTS

| | | | |
|---|---|---|---|
| 2,844,209 | 7/1958 | Brunderman | 296/3 |
| 2,984,277 | 5/1961 | Neff | 206/315.11 |
| 3,042,443 | 7/1962 | Laher | 248/96 |
| 4,117,963 | 10/1978 | Luczynski | 248/499 |
| 4,673,082 | 6/1987 | Hemme | 211/70.2 |
| 4,915,221 | 4/1990 | Spangler | 206/315.6 |
| 5,088,635 | 2/1992 | Taylor et al. | 224/274 |

FOREIGN PATENT DOCUMENTS

| | | | |
|---|---|---|---|
| 2804531 | 8/1979 | Fed. Rep. of Germany | 296/3 |
| 954930 | 4/1964 | United Kingdom | 296/3 |

*Primary Examiner*—H. Grant Skaggs

*Attorney, Agent, or Firm*—Jacobson, Price, Holman & Stern

[57] ABSTRACT

A golf club holder and dispenser used in combination with and mounted on a golf cart in order to securely retain a plurality of golf clubs in a stored position within a housing mounted transversely on the rear of the golf cart with the clubs being movable in a circular path to enable a desired club to be positioned for easy access and removal for use by a golfer and easy replacement. The holder and dispenser includes a pair of spaced circular club supporting members having a plurality of notches in the periphery thereof receiving the shafts of the golf clubs with the notched circular members being rotatably driven by a switch controlled reversible DC motor. The golf clubs are retained in position by a centrally disposed circular member of lesser diameter then the circular club supporting members and located intermediate the circular club supporting members. Resilient straps are anchored to the circular club supporting members and each strap is wrapped around a golf club shaft and connected to the periphery of the smaller diameter circular member to securely retain the golf clubs in mounted position in the notched circular members and enabling quick and easy removal and replacement of the golf clubs.

14 Claims, 3 Drawing Sheets

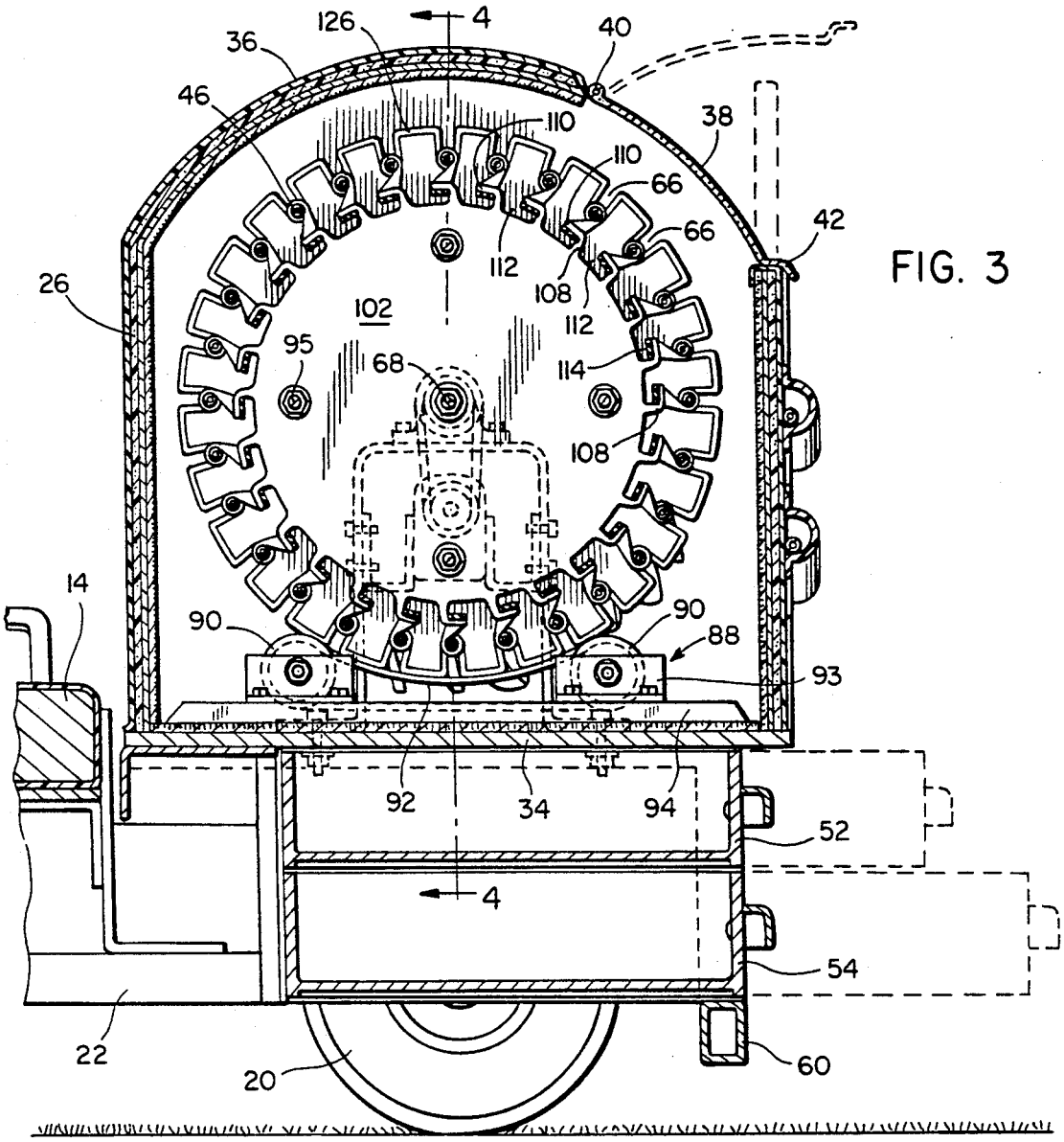
FIG. 3
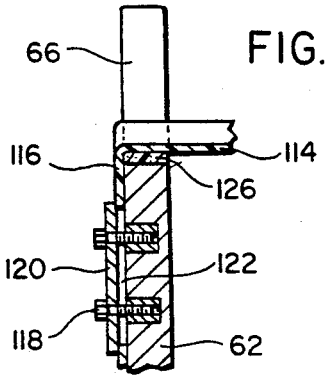
FIG. 6
FIG. 7
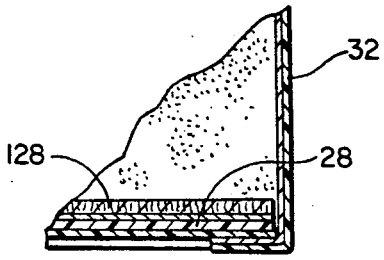

GOLF CLUB HOLDER AND DISPENSER

BACKGROUND OF THE INVENTION

1. Field of the Invention

The present invention generally relates to a golf club holder and dispenser used in combination with and mounted on a golf cart in order to securely retain a plurality of golf clubs in a stored position within a housing mounted transversely on the rear of the golf cart with the clubs being movable in a circular path to enable a desired club to be positioned for easy access and removal for use by a golfer and easy replacement. The holder and dispenser includes a pair of spaced circular club supporting members having a plurality of notches in the periphery thereof receiving the shafts of the golf clubs with the notched circular members being rotatably driven by a switch controlled reversible DC motor. The golf clubs are retained in position by a centrally disposed circular member of lesser diameter then the circular club supporting members and located intermediate the circular club supporting members. Resilient straps are anchored to the circular club supporting members and each strap is wrapped around a golf club shaft and connected to the periphery of the smaller diameter circular member to securely retain the golf clubs in mounted position in the notched circular members and enabling quick and easy removal and replacement of the golf clubs.

2. Description of the Prior Art

Various apparatuses have been developed to support golf clubs when being used by golfers. Golf bags with shoulder straps and carrying handles are conventionally used to carry a set of golf clubs while playing a round of golf with the golf bags either being carried by the individual golfers or by caddies. Hand propelled wheeled golf bag carts are frequently used to carry the golf bag rather than the golf bag being carried by the shoulder strap or handle. Powered golf carts are frequently used by golfers as they progress along the golf course rather than walking with the golf carts normally being provided with a structure on which several golf bags can be supported. To the knowledge of Applicant, there is no prior art that discloses a power driven golf club holder and dispenser that is mounted on a powered golf cart in accordance with the disclosure in this application.

SUMMARY OF THE INVENTION

An object of the present invention is to provide a golf club holder and dispenser adapted to be mounted transversely at the rear of a powered golf cart which securely supports and enables ready access to removal of and replacement of a plurality of golf clubs.

Another object of the invention is to provide a golf club holder and dispenser in accordance with the preceding object which includes an enclosing housing for the dispensing and holding mechanism which includes an openable closure door or panel to protect the golf clubs from inclement weather and other environmental conditions but yet enable quick and easy access thereto through the openable closure.

A further object of the invention is to provide a golf club holder and dispenser in accordance with the preceding objects which includes a pair of spaced, parallel circular club supporting members having peripheral notches receiving the shafts of a plurality of golf clubs with the circular members being rotatable with a horizontally supported shaft driven by a motor to enable a selected golf club to be aligned with the openable closure to enable the golf club to be removed, used and replaced.

Still another object of the invention is to provide a golf club holder and dispenser as defined in the preceding objects in which a circular club retaining member is mounted intermediate the circular club supporting members with a resilient strap secured to and extending between the circular club supporting members with a center portion of the strap being wrapped around a central portion of a golf club shaft and hooked to the retaining member to retain the golf club shafts in the notches of the supporting members.

A still further important object of the present invention is to provide a golf club holder and dispenser in accordance with the preceding objects in which the device is capable of supporting a plurality of clubs equal to at least the number of clubs normally authorized to be used by two golfers with the structure providing a weatherproof enclosure or cover with a transparent openable closure to enable observation of the golf clubs as they move past the closure thereby facilitating the alignment of a selected golf club with the openable closure.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a vertical sectional view, on an enlarged scale, taken along section line 3—3 on FIG. 1 illustrating specific structural details of the invention.

FIG. 6 is a fragmental sectional view taken along section line 6—6 on FIG. 2 illustrating the manner in which the resilient straps are secured to the circular support members.

FIG. 7 is a fragmental sectional view taken along section line 7—7 on FIG. 5 illustrating structural details of the housing or cover for the golf clubs.

DESCRIPTION OF THE PREFERRED EMBODIMENT

Figure 1:
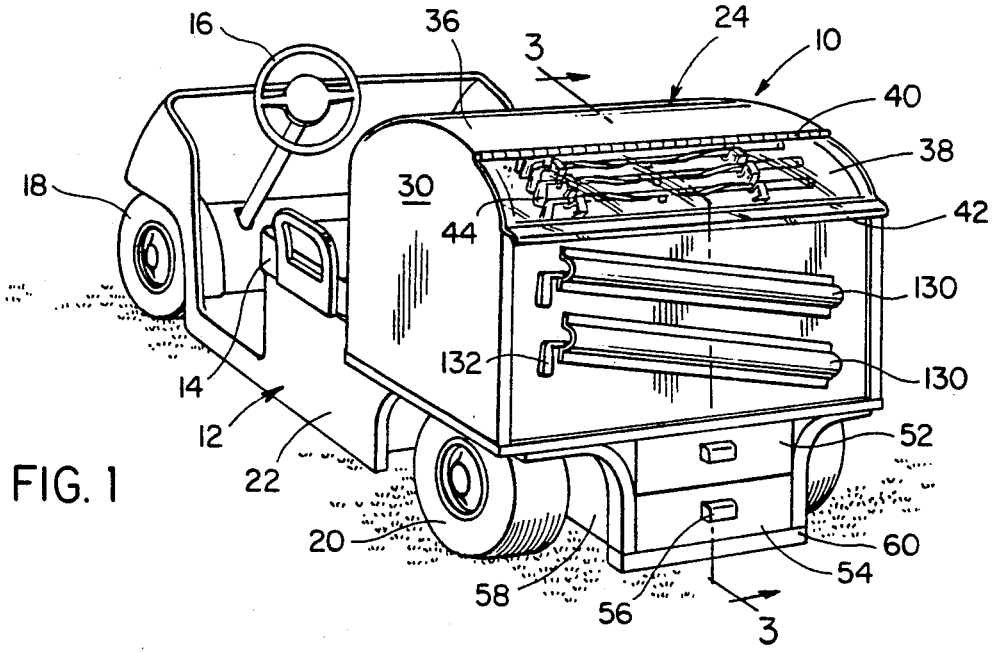
FIG. 1 is a perspective view of the golf club holder and dispenser of the present invention mounted on the rear of a golf cart.

Referring now specifically to the drawings, the golf club holder and dispenser of the present invention is generally designated by reference numeral 10 and, as illustrated in FIG. 1, it is mounted transversely at the rear of a conventional golf cart generally designated by reference numeral 12 which includes the usual seat 14 for two golfers, a steering wheel 16 and other controls, steerable wheels 18 at the front and traction wheels 20 at the rear with the cart 12 including a conventional chassis and frame structure 22 with the golf cart 12 being a conventional cart with the golf club holder and dispenser 10 mounted transversely at the rear thereof to enable the golfers to easily remove a selected golf club and replace it in position after use.

The holder and dispenser 10 includes a housing or cabinet generally designated by reference numeral 24 and which includes a front wall 26, a rear wall 28, vertical end walls 30 and 32, a bottom wall or platform 34 and an arcuate top wall 36. The top wall 36 includes a transparent openable closure 38 having a hinge structure 40 at its upper edge connected to the wall 36 and a laterally offset flange 42 at its lower edge engaged with and overlying the top edge of the rear wall 28 as illustrated in FIG. 3. This structure provides a weatherproof enclosure for a plurality of golf clubs 44 positioned within the housing 24 with the golf clubs 44 being conventional and provided with a shaft 46 and a handle 48 with the clubs 44 being arranged in sets with an authorized number of wood and iron clubs sufficient to enable two golfers to place their clubs in the holder and dispenser and enable any individual club to be selected, removed and replaced through the openable closure 38. The bottom wall 34 is in the form of a platform that is secured to the frame or chassis of the golf cart by suitable fastener bolts 50. Below the platform 34, a pair of slide-out drawers 52 and 54 are provided in which various items used by golfers can be stored with suitable handles 56 being provided on the drawer faces to enable the drawers to be moved longitudinally inwardly and outwardly as illustrated in broken line in FIG. 3. An enclosing structure 58 is provided for the drawers along with a supporting framework 60.

Internally of the housing or cabinet 24 the structure for supporting the golf clubs 44 includes a pair of circular supporting members 62 and 64 which are longitudinally spaced from each other with each of the circular members 62 and 64 having a plurality of notches 66 formed in the periphery thereof with the notches being circumferentially spaced from each other and the notches in one circular member 62 being in alignment with the notches in the other circular member 64 to receive and support the shafts 46 of the golf clubs 44 with the total number of notches preferably being 28 to enable each of two golfers to include 14 approved golf clubs. The club heads of the golf clubs of one golfer are positioned adjacent one end of the housing and the club heads cf the clubs for the other golfer are positioned adjacent the other end of the housing. Preferably, the golf heads used by the driver of the golf cart would be at the end of the housing adjacent the steering wheel while the club heads of the golf clubs used by other golfer would be adjacent the passenger side of the golf cart. The pair of circular supporting members 62 and 64 may be in the form of wood disks or plates that are rigidly supported on a centrally disposed support and drive shaft 68 that has the ends journaled in bearings 70 supported by an inverted U-shaped supporting brace or bracket 72 including depending legs 74 provided with outturned lower ends 76 secured to the platform by the bolts 50 which also secure the platform to the golf cart. Adjacent one end of the shaft 68, a sprocket gear 78 is mounted adjacent the supporting bracket 72 with a sprocket chain 80 engaging the sprocket gear 78 and also engaging a drive sprocket gear 82 mounted on the output shaft of a drive motor 84 supported on a bracket 86 mounted on the supporting legs 74 of the bracket 72. This structure enables the circular supporting members 62 and 64 to be driven by operation of the motor 84 to rotate the circular supporting members 62 and 64 about a horizontal axis defined the shaft 68.

Figure 2:
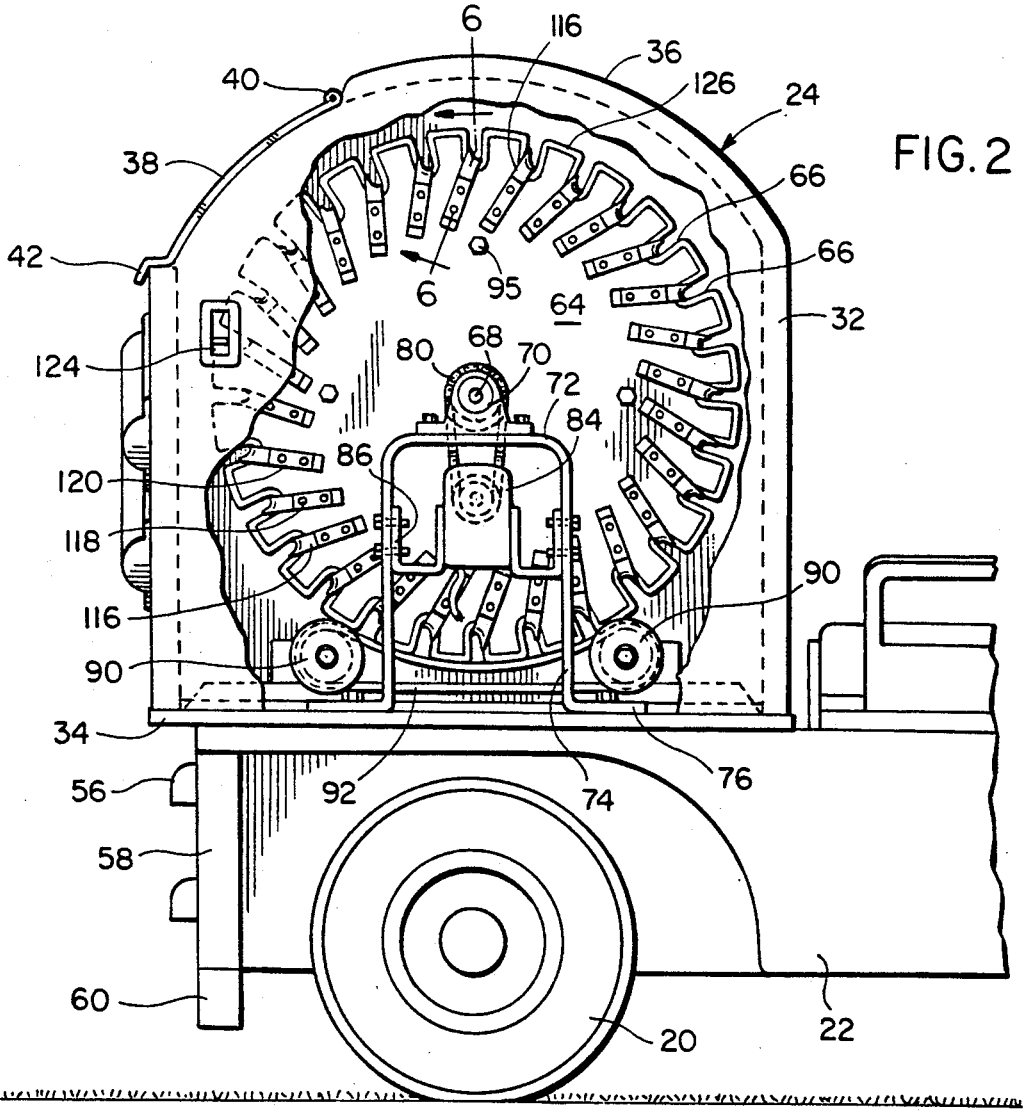
FIG. 2 is a side elevational view of the present invention with portions thereof broken away illustrating the support structure for the rotatable components of the invention.
Figure 4:
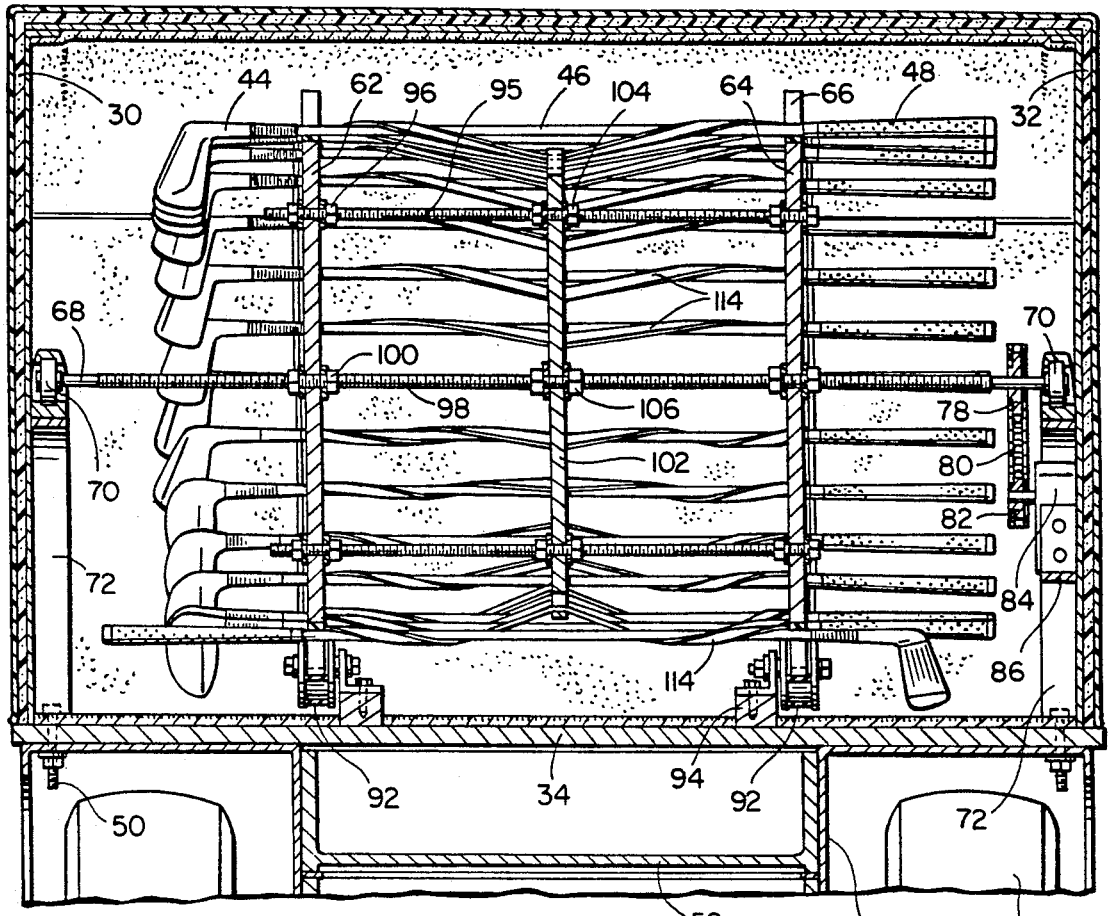
FIG. 4 is a longitudinal, sectional view taken substantially upon a plane passing along section line 4—4 on FIG. 3 illustrating further structural details of the invention.

In view of the relatively heavy weight of the golf clubs 44, a belt-type supporting assembly generally designated by reference numeral 88 is provided for each of the circular supporting members 62 with this structure including a pair of support wheels 90 rotatably supported by brackets 93 attached to support members 93 mounted on the platform 34. As illustrated in FIGS. 2 and 3, the supporting wheels 90 are spaced from the bottom center of the circular supporting members 62 and 64 and an endless belt 92 encircles the two wheels or pulleys 90 with the upper run of the belt 92 being deflected downwardly by its engagement with a portion of the periphery of the circular supporting members 62 or 64 with the belt thus forming a support for a portion of the periphery of the circular supporting members 62 and 64 thus relieving the shaft 68 of the necessity of supporting the weight of the golf clubs and the circular supporting members. The wheels or pulleys 90 are not powered and the belt 92 is caused to move due to its frictional supporting engagement with the periphery of the circular supporting members. This enables a relatively lightweight shaft 68 and supporting members 62 and 64 to be used with the belt 92 forming an effective support for the weight of the clubs as well as the weight of the supporting member and shaft 68.

In order to stabilize and position the circular supporting members 62 and 64 in relation to each other, a plurality of externally threaded spacer rods 95 interconnect the supporting members 62 and 64 with threaded nuts 96 being provided thereon to engage opposite surfaces of the supporting members 62 and 64 to maintain them in rigid parallelism. Also, the shaft 68 includes threaded portions 98 having threaded nuts 100 thereon for stabilizing the central portion of the circular members 62 and 64. As illustrated in FIG. 3, four threaded rods 95 are provided and are spaced equally circumferentially in relation to the supporting members 62 and 64.

To retain the golf club shafts 46 in the notches 66, there is provided a centrally disposed circular retaining member 102 which is of smaller diameter than the circular supporting members 62 and 64. The circular retaining member 102 is positioned between the circular supporting members 62 and 64 and is positioned and rigidly supported on the threaded rods 95 and the threaded portion 98 of shaft 68 by threaded nuts 104 on the rods 95 and threaded nuts 106 on the shaft 68 thus maintaining parallelism between the members 62, 64 and 102. As illustrated in FIG. 3, the periphery of the smaller diameter retaining member 102 is provided with a plurality of circumferentially spaced hook-shaped members 108 with the hook-shaped members being aligned with the notches 66. Each hook-shaped member 108 includes an outer end portion 110 which extends generally circumferentially in relation to the periphery of the circular member 102 and in spaced relation thereto to provide an entrance area 112 that faces generally in tangential relation to the periphery of the circular retaining member 102.

Figure 5:
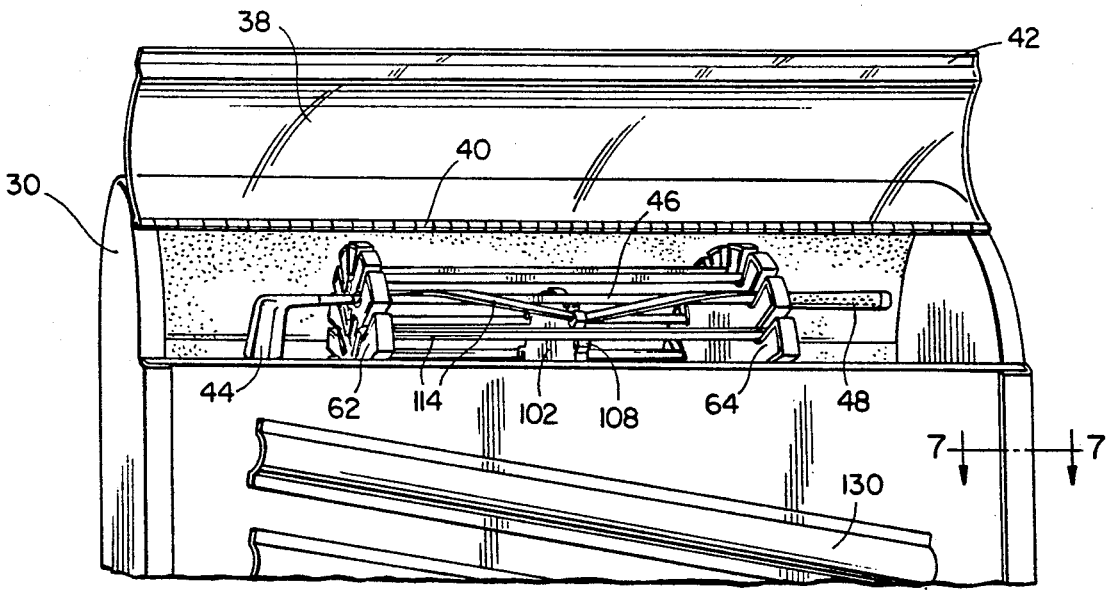
FIG. 5 is a fragmental rear perspective view of the invention illustrating the openable closure in open position to provide access to a selected golf club.

An elongated resilient strap 114 is associated with each golf club shaft 46 to retain the golf club shaft in the notches 66. The strap 114 is constructed of elastic or resilient material such as foam rubber and has end portions which extend through the interior of a pair of aligned notches 66 and then extend inwardly along the outer surface of the supporting members 62 and 64 with the end portions of the strap 114 being designated by reference numeral 116 as illustrated in FIG. 6. The end portion 116 of each strap 114 is attached to the external surface of a supporting member 62 or 64 by fastening members 118 and a clamp plate 120 with the structure enabling adjustment of the strap 114 by the strap either having a slot 122 formed therein or the fasteners can be wood screw fasteners which can be inserted through the resilient strap at any point thus enabling the effective length and thus the resiliency of the strap 114 to be adjusted. As illustrated in FIG. 5, the straps 114 at the lower and upper portion of the figure are straight and are not in retaining relation to a golf club shaft. However, the central strap 114 associated with the golf club shaft 46 has been wrapped counterclockwise around the shaft 46 by grasping the center of the strap 114 and moving it around the center of the shaft 46 one revolution and then the center of the resilient strap is inserted through the entrance 112 to a position underlying and engaging the end portion 110 of the hook-shaped member 108 as illustrated in FIG. 5 and also as illustrated in FIG. 3. Thus, the strap 114 associated with each of the club shafts 46 is wrapped in the same counterclockwise manner around the shaft 46 and the central portion of the strap inserted into engagement with the hook 108 thereby releasably and resiliently but securely retaining each golf club shaft 46 in the notches 66.

The motor 84 is controlled by a switch 124 positioned on end wall 32 or any other convenient location with the motor being a reverse polarity DC motor and the switch enabling the motor to be operated to drive the shaft 68 and the supporting and retaining members mounted thereon in either direction and stopped with a desired golf club in registry with the openable closure 38 with the transparency of the closure 38 enabling observation of the golf clubs. The DC motor can be powered by any suitable battery power source such as a 12 volt battery, two 6 volt batteries in series or the battery power system for the golf cart with the power circuit being protected by a suitable fuse. As illustrated in the drawings, the peripheral wall of the housing or cabinet has a double wall of aluminum sheets and, if desired, one of the inner walls may be positioned internally of the bracket 72 and drive structure with a suitable aperture to receive the shaft 68. This enables a wall to be positioned internally of the drive sprockets and drive chain to conceal the driving structure and eliminate any possible injury by coming into contact with the drive structure. The exterior aluminum sheet forming the wall may be covered by a thin layer of foam rubber adhesively mounted thereon which is covered by an attractive adhesively attached plastic sheet that is waterproof and attractive in appearance so that the interior of the housing will be kept dry at all times and the exterior of the housing will be attractive in appearance. If desired, the complete top wall may be pivoted to enable access to make repairs and, if desired, the rear wall 28 may also be removable as illustrated in FIG. 7. The retaining bars 120 may be provided with a number to indicate the number of the club positioned in that particular pair of notches and black dots or the like may be placed on each golf shaft at the center thereof so that the black dot can be aligned with the retaining member and face directly outwardly to position the club head correctly in relation to each other and to the end supporting members and the central retaining member. The resilient strap 114 wrapped around each club shafts prevents the club shafts and club heads from rotating thereby maintaining the club heads in desired spaced relation and preventing the club heads from coming into contact with each other as the golf cart is driven over uneven terrain on the golf course. The notched wheels including the notches are peripherally covered by rubber, foam rubber and a tough wrapping tape as indicated by reference numeral 126 in FIG. 6 and the interior of the housing may be provided with a covering in the form of a rug, foam rubber or the like as indicated by reference numeral 128. The rear wall 28 includes a pair of inclined elongated sleeves 130 having an upper outer end to enable a putter 132 to be positioned and supported therein. The materials from which the housing is constructed may vary and may be adapted to be mounted on various types of golf carts and, in some instances, can be attached directly to the existing fenders of a golf cart. The use of rug or foam rubber interior and exterior with protective plastic sheeting prevents damage to the clubs, prevents injury to persons using the device and provides a weather-tight and attractive attachment to a golf cart. The golf clubs are retained securely in position but yet they can be easily removed and replaced with the golf clubs being easily moved in a circular path by manipulating the switch to drive the shaft and thus the clubs in either direction to align a desired club with the openable closure with the transparency of the openable closure enabling the desired club to be stopped in registry with the openable closure to provide access to the desired club.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A golf club holder and dispenser comprising a pair of spaced club support members, each of said support members having a generally circular periphery having a plurality of radial notches therein receiving spaced portions of a plurality of golf club shafts, means supporting said support members for rotation about a central axis, means driving said support members to move the golf clubs in a generally circular path and means intermediate said support members engaging a portion of each of the golf club shafts between the portions of the shafts received in the notches to retain the golf clubs in said notches during movement and enabling removal of a selected club when movement of the clubs ceases, said means driving said support members including a batter powered, switch controlled reversible electric motor drivingly connected to said support means.

2. The golf club holder and dispenser as defined in claim 1 together with a housing enclosing said members and clubs, said housing including access means to enable access to a selected club when stopped in registry with the access means.

3. The golf club holder and dispenser as defined in claim 2 wherein said housing includes means mounting the housing transversely across the rear of a golf cart.

4. The holder and dispenser as defined in claim 1 wherein said support members are circular plates, said notches being equally spaced around the periphery of said plates.

5. The holder and dispenser as defined in claim 1 wherein said means supporting said support members includes a horizontal shaft having said support members rigidly affixed thereto with the notches in the support members being in aligned registry with each other.

6. The golf club holder and dispenser as defined in claim 1 wherein said means positioned between said support members includes a circular club retaining member having an external periphery positioned inwardly of the external periphery of the support members, said circular club retaining member being rigidly affixed to said means supporting the support members for rotation therewith.

7. A golf club holder and dispenser comprising a pair of spaced club support members, each of said support members having a generally circular periphery having a plurality of radial notches therein receiving spaced portions of a plurality of golf club shafts, means supporting said support members for rotation about a central axis, means driving said support members to move the golf clubs in a generally circular path and means intermediate said support members engaging a portion of each of the golf club shafts between the portions of the shaft received in the notches to retain the golf clubs in said notches during movement and enabling removal of a selected club when movement of the clubs ceases, said means positioned between said support members including a circular club retaining member having an external periphery positioned inwardly of the periphery of the support members, said circular club retaining member being rigidly affixed to said means supporting the support members for rotation therewith, said circular retaining member including a plurality of spaced hook means on the periphery thereof, and resilient means selectively engagable with each of said hook means and the golf club shaft to retain the golf clubs in the notches in the support members when the resilient means engages each of said hook means.

8. The golf club holder and dispenser as defined in claim 7 wherein said resilient means includes an elongated resilient strap having end portions which extend through the notches and secured to said support members, each resilient strap including an elongated central portion wrapped around the golf club shaft and engaged with one of said hook means to resiliently and releasably retain the golf clubs in the notches.

9. The golf club holder and dispenser as defined in claim 8 together with a housing enclosing said members and clubs, said housing including access means to enable access to a selected club when stopped in registry with the access means.

10. The golf club holder and dispenser as defined in claim 9 wherein said support members are circular plates, said notches being equally spaced around the periphery of said plates.

11. The golf club holder and dispenser as defined in claim 10 wherein said means supporting said support members includes a horizontal shaft having said support members rigidly affixed thereto with the notches in the support members being in aligned registry with each other.

12. The holder and dispenser as defined in claim 11 wherein said means driving said support members includes a battery powered, switch controlled reversible electric motor drivingly connected to said support means.

13. In combination, a golf cart having an upwardly facing supporting area, a golf club holder and dispenser mounted on the supporting area of the golf cart, said holder and dispenser including rotatable means supported from the golf cart supporting area and means releasably mounting a plurality of golf clubs from said rotatable means, said means releasably mounting a plurality of golf clubs including a pair of spaced circular disks with each disk having a plurality of circumferentially spaced notches therein receiving golf club shafts, and means positioned between said disks and in spaced relation thereto for exerting radial inward resilient force on each golf club shaft to hold each shaft in said notches.

14. The combination as defined in claim 13 wherein said means positioned between said disks includes a resilient strap attached to said disks in alignment with and extending through opposed notches, the center of said strap being wrapped around a golf club shaft and connected to a centrally disposed anchor member rotatable with and rigid with said disk and located intermediate said disk.

* * * * *